United States Patent [19]

Allegra et al.

[11] 4,264,684

[45] Apr. 28, 1981

[54] ZINC-ALLOY COATED FERROUS PRODUCT RESISTANT TO EMBRITTLEMENT

[75] Inventors: Louis K. Allegra; James B. Horton, both of Bethlehem; Herbert E. Townsend, Center Valley, all of Pa.

[73] Assignee: Bethlehem Steel Corporation, Bethlehem, Pa.

[21] Appl. No.: 104,615

[22] Filed: Dec. 17, 1979

[51] Int. Cl.[3] ..... C23C 1/02; C23C 1/08

[52] U.S. Cl. ..... 428/653; 428/659; 427/383.9; 427/433

[58] Field of Search ..... 75/123 D; 428/659, 653; 427/433, 309, 321

[56] References Cited

U.S. PATENT DOCUMENTS

| | | | |
|---|---|---|---|
| 2,283,868 | 5/1942 | Fowle et al. | 75/123 D |
| 3,343,930 | 9/1967 | Borzillo et al. | 428/659 |
| 3,782,909 | 1/1974 | Cleary et al. | 428/659 |
| 4,053,663 | 10/1977 | Caldwell et al. | 427/433 |

OTHER PUBLICATIONS

Bablik, Galvanizing, E. & F. N. Spon. Ltd., 1926, pp. 56, 57.

Gerber, The Influence of Steel Quality on Coating Thickness in Hot Dip Galvanizing, 5th International Conf. on Hot Dip Galvanizing, 1958, pp. 267–270.

Horstmann, The influence of steel and of galvanizing conditions . . . 7th International Conf. on Hot Dip Galvanizing, Jun. 1964, pp. 146–166.

*Primary Examiner*—Ralph S. Kendall

*Attorney, Agent, or Firm*—Joseph J. O'Keefe; William B. Noll

[57] ABSTRACT

This invention is directed to an improved zinc containing metallic coated ferrous product, particularly sheet and strip, which is resistant to intergranular penetration by zinc and embrittlement of the ferrous base. Use of such zinc containing metallic coated ferrous product in elevated-temperature service, such as found with certain appliances and automotive exhaust components, is enhanced by the coated products of this invention. The resistance to embrittlement of the zinc containing metallic coated ferrous base, when subjected to elevated service temperatures, is achieved by the use of a high-phosphorus containing steel base. For a plain content steel base, a phosphorus content of at least 0.020% by weight, preferably at least 0.030%, and more preferably at least 0.039% was found sufficient to render such zinc-alloy coated ferrous base resistant to embrittlement by zinc.

By use of such high phosphorus ferrous base, for the reception of a zinc containing alloy coating, an improved metallic coated ferrous product has been found which resists intergranular penetration by zinc and embrittlement of the ferrous base. Such coated product has extended service life at temperatures above about 450° F. (232° C.) and when restored to room temperature possesses a high degree of ductility.

14 Claims, 5 Drawing Figures

EMBRITTLEMENT SUSCEPTABILITY OF Al-Zn ALLOY COATED FERROUS PRODUCT

EMBRITTLEMENT SUSCEPTABILITY OF GALVANIZED FERROUS PRODUCT

ZINC-ALLOY COATED FERROUS PRODUCT RESISTANT TO EMBRITTLEMENT

DESCRIPTION

1. Technical Field

This invention is directed to the field of metallic coated ferrous products, particularly sheet and strip, where the metallic coating provides barrier and sacrificial type protection to the underlying ferrous base. Preferably this invention relates to continuous-strip, metallic coated steel, where zinc is a component of the metallic coating, such as hot-dip galvanized steel and aluminum-zinc alloy coated steel, that exhibits improved characteristics at elevated service temperatures above about 450° F. (232° C.).

2. Background of the Prior Art

Elevated-temperature heating of zinc containing metallic coated steel, depending upon the thermal history of such heating, i.e. time, temperature and frequency, has been observed to cause a deterioration of the coating and embrittlement of the underlying steel base. J. J. Sebisty, in *Electrochemical Technology,* V. 6, No. 9–10, Sept.-Oct. 1968, pp. 330–336, reported his investigation of air-atmosphere heating of continuous-strip galvanized products in the temperature range of 300°–750° F. (150°–400° C.) for periods up to twenty weeks. Sebisty noted that one form of product deterioration "was represented by severe steel base penetration and embrittlement." Further, this embrittlement was accelerated at temperatures in excess of about 480° F. (250° C.). Though no actual limiting service temperature was established, Sebisty concluded that the maximum permissible service temperature for continuous-strip galvanized steel is significantly below 570° F. (300° C.).

Embrittlement is a phenomenon common to steels having zinc containing metallic coatings, i.e. coatings where zinc is a component of the coating. When such coated steels are heated within a certain temperature range, zinc from the coating diffuses into the base steel via the ferrite grain boundaries. Such phenomenon will be described later in conjunction with FIGS. 1A, 1B, and 1C. Room-temperature ductility decreases as zinc penetration during diffusion increases. One criterion used to determine if the steel base has embrittled is fracture along at least 50% of a zero thickness (OT) bend made in a zinc containing metallic coated specimen at room temperature. Since zinc diffusion is a thermally-activated process, the time required for embrittlement to occur depends on the thermal history of such process, whether the coated product is held at a fixed temperature or through cyclic heating and cooling, and by the steel sheet thickness.

One obvious limiting factor, over and above the embrittlement problem noted above, to high temperature service of coated steel products is the maintenance of the integrity of the coating at such high temperature. That is, such service temperature must be below that at which the coating begins to deteriorate. With galvanized steel, i.e., steel coated with zinc containing only minor additions of other metals, the range of temperatures at which the steel becomes embrittled is substantially contiguous with the temperature where coating breakdown begins to occur; see FIG. 3B and the discussion which follows later. Thus, conventional galvanized steel is significantly limited as to high temperature service, for example, 480° F. (250° C.) as reported by Sebisty. However, a zinc containing coating may have its high temperature service increased by making additions of alloying elements to the coating. This may result in the establishment of a specific and limiting embrittling temperature range below that temperature at which the zinc containing alloy coating begins to deteriorate. This characteristic has been observed with aluminum-zinc alloy coated steels of the type described in U.S. Pat. No. 3,343,930 to Borzillo et al, and is illustrated in FIG. 3A. That is, such aluminum-zinc coated steels, within a limited range of temperatures below that at which the aluminum-zinc coating begins to deteriorate, will not be susceptible to embrittlement. Within such limited range of temperatures, above the embrittling temperature range, zinc diffusion into the grain interiors, rather than along the ferrite grain boundaries, becomes the dominant mode and the steel remains ductile. If a previously embrittled aluminum-zinc alloy coated steel is heated above the embrittling range, it will revert to a ductile behavior. This is only a partial answer to the embrittlement problem for aluminum-zinc alloy coated steel, however, as one must still be selective in the application of such coated steel for high temperature service.

The present invention, by the use of a high phosphorus, plain carbon steel base, provides a way to broaden the use of zinc containing metallic coated steel in high temperature service. Though phosphorus has long been known as an impurity in steel, and in fact as a deliberate addition thereto for strength, see U.S. Pat. No. 3,827,924 to Takechi et al, the present invention is the first recognition of the embrittlement inhibiting nature of phosphorus in a steel base coated with a zinc containing metallic alloy and subjected to high temperature service above about 450° F. (232° C.) up to a temperature at which such coating begins to deteriorate.

SUMMARY OF THE INVENTION

This invention is directed to an improved metallic coated ferrous product having zinc as a component of the coating, that is resistant to embrittlement of the ferrous base caused by intergranular penetration by zinc at temperatures above about 450° F. (232° C.). Use of such matallic coated ferrous product in elevated-temperature service, such as found with certain appliances and automotive exhaust components, is enhanced by the metallic coated ferrous products of this invention. Resistance to embrittlement, for example, of zinc containing metallic coated, plain carbon steel base, when subjected to elevated service temperatures, is achieved by the use of a high-phosphorus containing steel base. For such plain carbon steel base, a phosphorus content of at least 0.020%, by weight, preferably at least 0.030% and more preferably at least 0.039% was found sufficient to render such zinc-alloy coated steel base resistant to embrittlement by zinc at temperatures above about 450° F. (232° C.).

By use of such high phosphorus steel base, for the reception of a metallic coating containing zinc, an improved metallic coated ferrous product has been found which resists intergranular penetration by zinc and embrittlement of the steel base. Such coated product may have an extended service life at temperatures above about 450° F. (232° C.) up to about 1250° F. (677° C.).

DETAILED DESCRIPTION OF INVENTION

This invention relates to an improved metallic coated ferrous base product, having zinc as a component of the coating and high phosphorus as a component of the ferrous base, that is resistant to embrittlement when exposed to temperatures above about 450° F. (232° C.). More particularly, the invention is directed to improved hot-dip galvanized and aluminum-zinc alloy coated steel products, such as sheet, strip or wire. The latter alloy coated product is the subject of U.S. Pat. Nos. 3,343,930; and 3,393,089; i.e. an aluminum-zinc coated ferrous base having a coating consisting of 25–70%, by weight aluminum, silicon in an amount of at least 0.5%, by weight, of the aluminum content, balance substantially zinc. The hot-dip coated products to which this invention relates are characterized by a coating containing zinc as a component thereof, and by a plain carbon steel base whose chemistry typically falls within the following limits, by weight, carbon—0.15% max.
manganese—0.25 to 0.60%
phosphorus—0.020% min.
sulfur—0.025% max.
silicon—0.040% max.

Figure 1A:
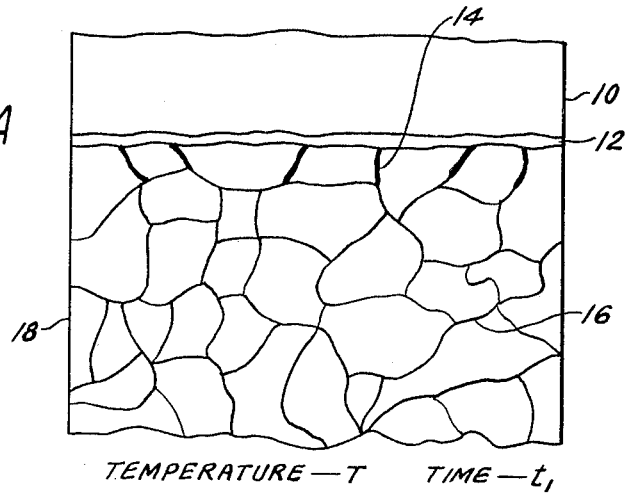
FIGS. 1A, 1B, and 1C are representations of photomicrographs, at about 500X, of zinc-containing, metallic coated ferrous products produced according to the prior art, heated to an embrittling temperature (T) and held for a time ($t_1$, $t_2$ and $t_3$), where $t_1<t_2<t_3$, to illustrate intergranular penetration by zinc into the steel base of the coated product.
Figure 1B:
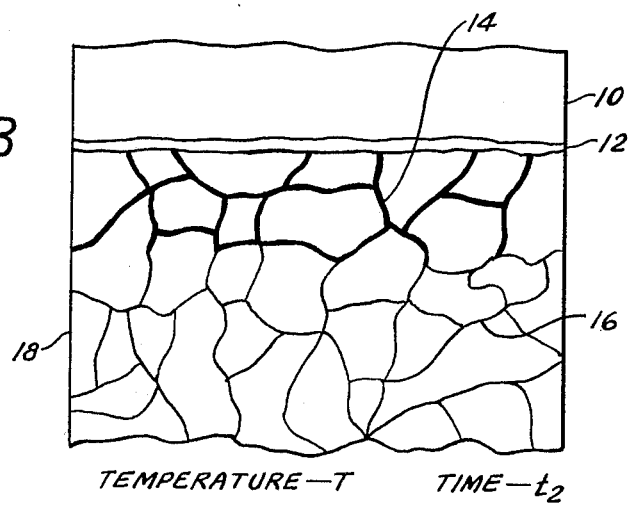
Figure 1C:
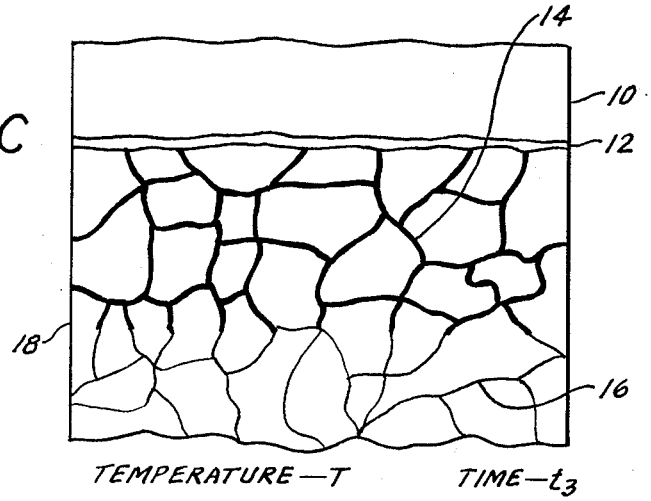
Figure 2:
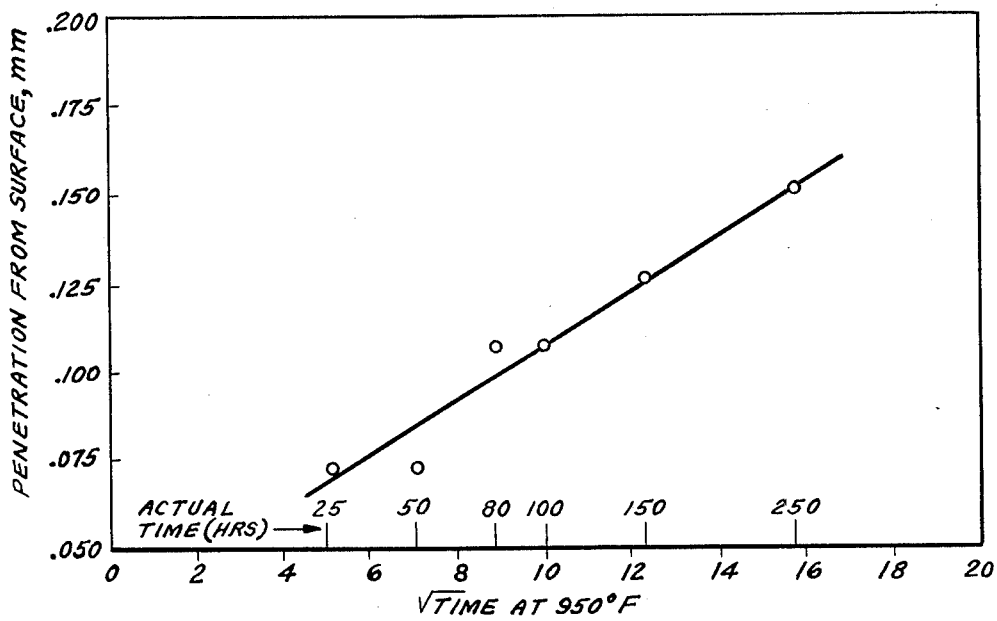
FIG. 2 is a graph of data showing the depth of zinc penetration into the ferrous base of an aluminum-zinc alloy coated ferrous product as a function of time for a heating temperature of 950° F. (510° C.).

Experience has shown that high temperature applications, where such high temperature is either constant or a combination of short periods resulting from cyclic heating and cooling, for zinc containing metallic coated products are limited due to embrittlement of the underlying steel base. This embrittlement is illustrated in FIGS. 1A to 1C. Such FIGURES are simplified representations of photomicrographs taken through a series of embrittled, zinc-containing, metallic coated ferrous products as they might appear at a magnification of about 500X. FIGS. 1A to 1C show the progression of zinc penetration at various times, where $t_1<t_2<t_3$, the times at temperature T for FIGS. 1A, 1B and 1C, respectively. Research investigators have determined, as FIGS. 1A to 1C illustrate, that the embrittlement mechanism is the result of zinc from the coating 10, diffusing upon heating through the intermetallic alloy layer 12, a characteristic feature of continuous, hot-dip zinc containing coated ferrous products. The diffused zinc 14 settles along the ferrite grain boundaries 16 of the steel base 18 thereby weakening the grain boundary/matrix interface. FIGS. 1A to 1C show generally the increasing amount of zinc penetration with increasing time at temperature. Quantitative analysis of the type of penetration depicted in FIGS. 1A to 1C, for an aluminum-zinc alloy (55% Al, 1.6% Si, balance Zn) coated steel sheet produced by prior art practices, produces the penetration versus time curve of FIG. 2. The data for such curve was obtained from 30 gage (0.39 mm) steel sheet, having an aluminum-zinc alloy coating of about 0.8 mils thickness, heated to 950° F. (510° C.) and held for the times indicated. FIG. 2 shows a definite linear increase in depth of zinc penetration with the square root of time at temperature. From the data of FIG. 2, knowing the gage, i.e. thickness, of the underlying steel base, one can determine directly, or by extrapolation, the time at temperature in which the underlying steel base will be fully penetrated. Thus, steel base thickness adds another dimension to the embrittlement problem.

Any attempt to form these high temperature exposed and cooled zinc containing metallic coated steels, or any service strains such as an impact against the coated steels, particularly thin coated steel sheets, may cause such steels to fracture. This fracture, caused by embrittlement of the steel base, limits use of these coated steel products to temperatures where such products will not be subjected to forming or service strains.

Efforts have been made to control such embrittlement phenomenon. Those efforts have centered primarily on the metallurgy of the coating, i.e. alloy overlay and intermetallic alloy layer, and on the grain size of the underlying steel base. At best these approaches met with only limited success.

The solution to the embrittlement problem embodied in the present invention is unique in that the chemistry of the base steel has been modified by enrichment with phosphorus. It has been found that with plain carbon steels, the typical base steels for metallic, hot-dip coating operations, a phosphorus content of at least 0.020%, by weight, preferably at least 0.030%, by weight, more preferably at least 0.039%, will be sufficient to prevent intergranular penetration by zinc and embrittlement of such steel base after exposure to high temperature service conditions above about 450° F. (232° C.). Typical phosphorus content for plain-carbon steels of the type heretofore used for metallic, hot-dip coating operations is about 0.010 to 0.015%, by weight. Some specific reported values for the phosphorus content of the steel base are 0.029% max. (U.S. Pat. No. 4,053,663), 0.01% to 0.011% U.S. Pat. No. 4,029,479), 0.010% (U.S. Pat. No. 3,993,482 ), and 0.01% (Sebisty article noted earlier).

To demonstrate the effectiveness of this invention to the problems associated with intergranular penetration by zinc and embrittlement of the steel base, a series of fourteen steel base specimens, having a range of phosphorus contents, were hot-dip coated with zinc or with aluminum-zinc. Specifically, the zinc containing metallic coatings comprised a conventional galvanized coating and an aluminum-zinc coating, nominally consisting of 55% aluminum, 1.6% silicon, balance essentially zinc, hereinafter referred to as Al-Zn. The chemical analyses of the fourteen steel base specimens are listed in Table I.

TABLE I

CHEMICAL ANALYSIS OF BASE STEELS TESTED FOR EMBRITTLEMENT SUSCEPTIBILITY

| Base Steel* | C | Mn | P | S | Si | Cu | Al | N | Other |
|---|---|---|---|---|---|---|---|---|---|
| 1 | .044 | .38 | .003 | .009 | .01 | .011 | .005 | .003 | |
| 2 | .080 | .36 | .003 | .022 | .01 | .025 | .044 | .0082 | Ti = .006 As = .0073 |
| 3 | .097 | .53 | .005 | .020 | .01 | .015 | .005 | .011 | Ti = .006 |
| 4 | .043 | .34 | .010 | .012 | .022 | .020 | .046 | .0116 | Cr = .020 As = .0054 |
| 5 | .061 | .48 | .039 | .009 | .012 | .040 | .027 | .0063 | |
| 6 | .021 | .54 | 0.42 | .015 | .053 | .01 | .063 | .0057 | |
| 7 | .049 | .33 | .062 | .007 | .012 | .040 | .025 | .0054 | |
| 8 | .054 | .35 | .074 | .017 | .035 | .062 | .039 | .0142 | Cr = .042 Ni = .030 As = .0092 |
| 9 | .048 | .54 | .091 | .022 | .03 | .045 | .056 | .0057 | |
| 10 | .035 | .32 | .094 | .019 | .01 | .032 | .041 | .0105 | |
| 11 | .081 | .56 | .095 | .013 | .01 | .028 | .005 | .0052 | Sb = .009 |
| 12 | .020 | .37 | .096 | .007 | .025 | .020 | .011 | .0046 | |
| 13 | .053 | .26 | .098 | .017 | .025 | .050 | .043 | .0080 | |
| 14 | .070 | .40 | .12 | .013 | .042 | .030 | .049 | .0077 | |

*Base steels were produced by a variety of practices, including: Rimmed, Capped, Al-Killed; and cold-rolled to thicknesses between .018 to .023 inches

TABLE II

TENSILE ELONGATION(%) AFTER HEATING AT 900° F.

| Base Steel | Galvanized Coating | | | | Al-Zn Coating | | | |
|---|---|---|---|---|---|---|---|---|
| | R.T.* | 100 hrs. | 300 hrs. | 600 hrs. | R.T.* | 100 hrs. | 300 hrs. | 600 hrs. |
| 1 | 27.7% | 0.0% | 0.0% | 0.0% | 3.0% | 2.4% | 0.8% | 0.0% |
| 2 | 37.0% | 25.7% | 24.0% | 0.0% | 16.7% | 20.3% | 11.8% | 0.0% |
| 3 | 34.0% | 0.0% | 0.0% | 0.0% | 18.3% | 11.0% | 3.0% | 0.0% |
| 4 | 33.7% | 0.0% | 0.0% | 0.0% | 19.0% | 2.5% | 0.0% | 0.5% |
| 5 | 30.7% | 14.3% | 10.4% | 2.3% | 16.7% | 17.0% | 15.0% | 13.7% |
| 6 | 31.0% | 21.0% | 21.0% | 18.0% | 18.7% | 22.0% | 22.7% | 23.7% |
| 7 | 34.0% | 25.0% | 26.0% | 24.7% | 18.7% | 24.7% | 23.0% | 22.7% |
| 8 | 29.7% | 28.3% | 27.0% | 25.0% | 15.7% | 22.3% | 20.0% | 20.3% |
| 9 | 31.7% | 26.7% | 23.3% | 25.7% | 20.7% | 21.3% | 20.7% | 20.7% |
| 10 | 33.3% | 24.7% | 25.3% | 25.0% | 18.7% | 21.0% | 18.3% | 18.2% |
| 11 | 29.7% | 27.7% | 28.7% | 27.0% | 17.3% | 19.3% | 26.7% | 22.7% |
| 12 | 32.7% | 25.3% | 23.3% | 23.7% | 18.3% | 15.2% | 16.3% | 22.7% |
| 13 | 30.0 | 23.0% | 23.7% | 23.3% | 18.0% | 23.7% | 24.3% | 22.7% |
| 14 | 29.7% | 26.3% | 25.7% | 23.7% | 15.7% | 16.5% | 15.5% | 18.7% |

*Room Temperature Tensile Elongation prior to Heating

Tensile elongations, measured in percent elongation in 2 inches after heating for 100 to 600 hours at 900° F. (482° C.) in air and cooling to room temperature, are shown in Table II.

The relatively high tensile elongation, i.e. ductility, at room temperature of base steel samples 5–14 demonstrate the samples' ability to withstand a zero thickness (OT) bend without fracture. This further demonstrates that formed products, such as automotive exhaust components, appliances and the like manufactured from the coated product of this invention, will successfully resist impact without fracturing after having been exposed to temperatures above about 450° F. (232° C.).

Figure 4:
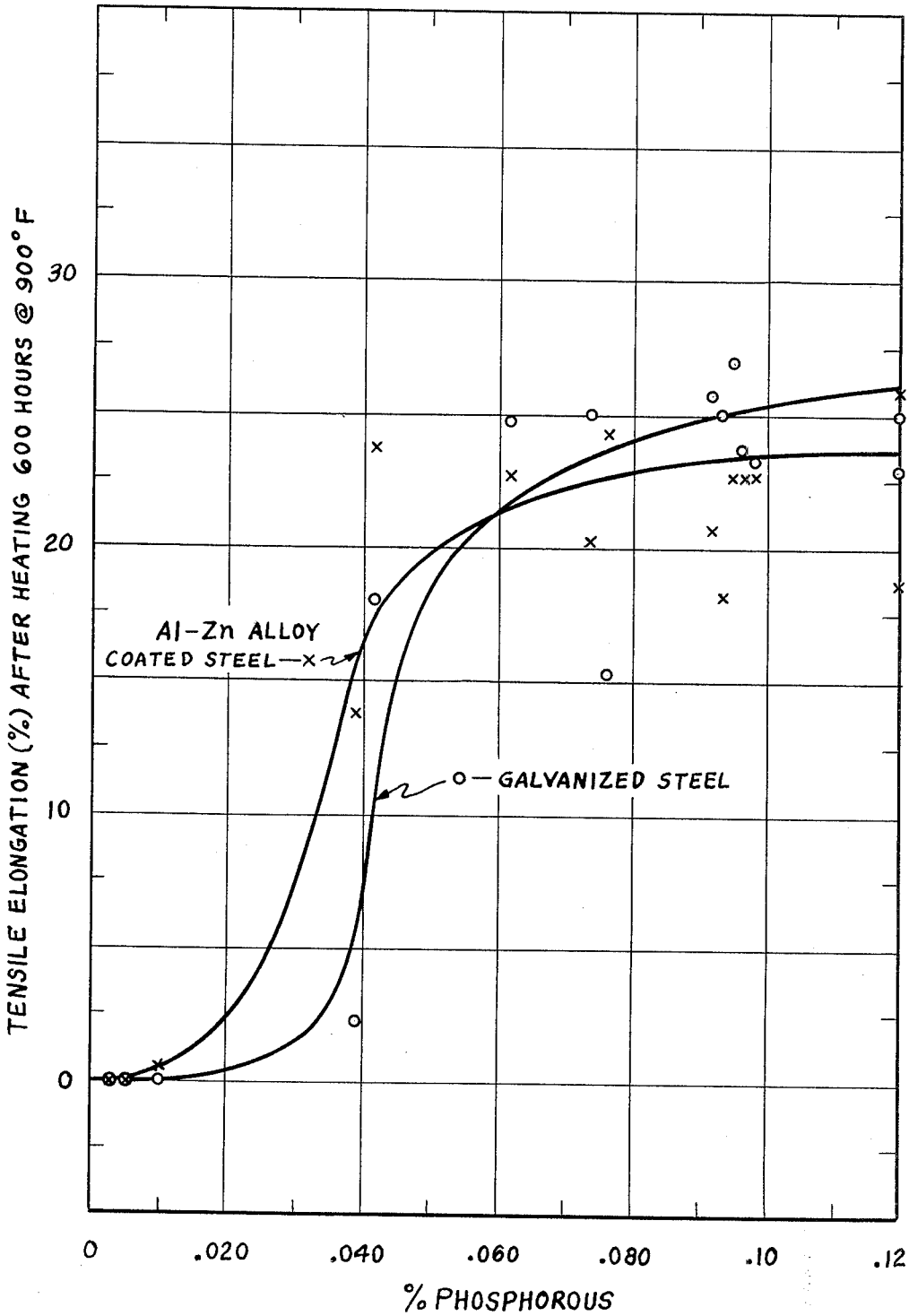
FIG. 4 presents data showing the tensile elongation, i.e. ductility, of galvanized and aluminum-zinc alloy coated steels, after exposure to an embrittling temperature, where the base steel compositions have been modified by additions of phosphorus.

FIG. 4 is the plot of data for the 600 hour test noted in Table II. A break in the data begins to appear at phosphorous contents above about 0.020%, by weight, and becomes more evident at phosphorous levels above 0.030%. The scatter of data points, most apparent at phosphorus levels above about 0.060%, is due primarily to the inherent differences in the base steels, i.e. differences in carbon content and microstructure.

Figure 3A:
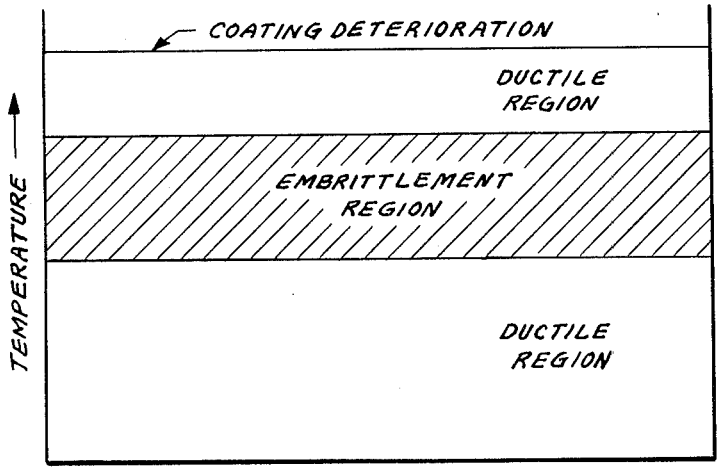
FIG. 3A shows the general effect of temperature on the embrittlement of aluminum-zinc alloy coated steel sheet, where the base steel produced according to the prior art, nominally contains about 0.01%, by weight phosphorus, and a unique characteristic of such aluminum-zinc alloy coated steel in which the embrittlement range is disposed between high temperature and low temperature non-embrittling ranges.
Figure 3B:
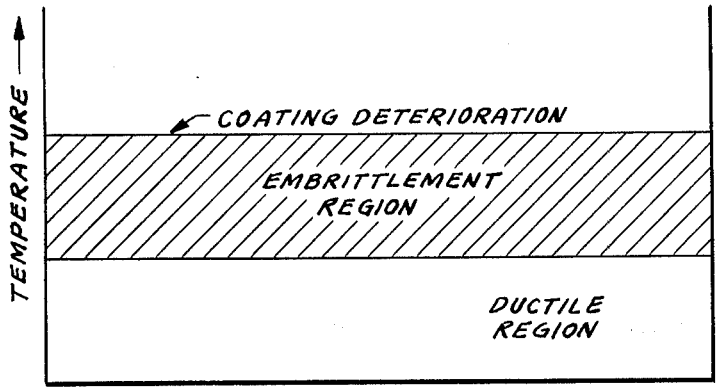
FIG. 3B is similar to FIG. 3A, except that FIG. 3B illustrates the general effect of temperature on the embrittlement of galvanized steel produced according to the prior art.
Figure 5:
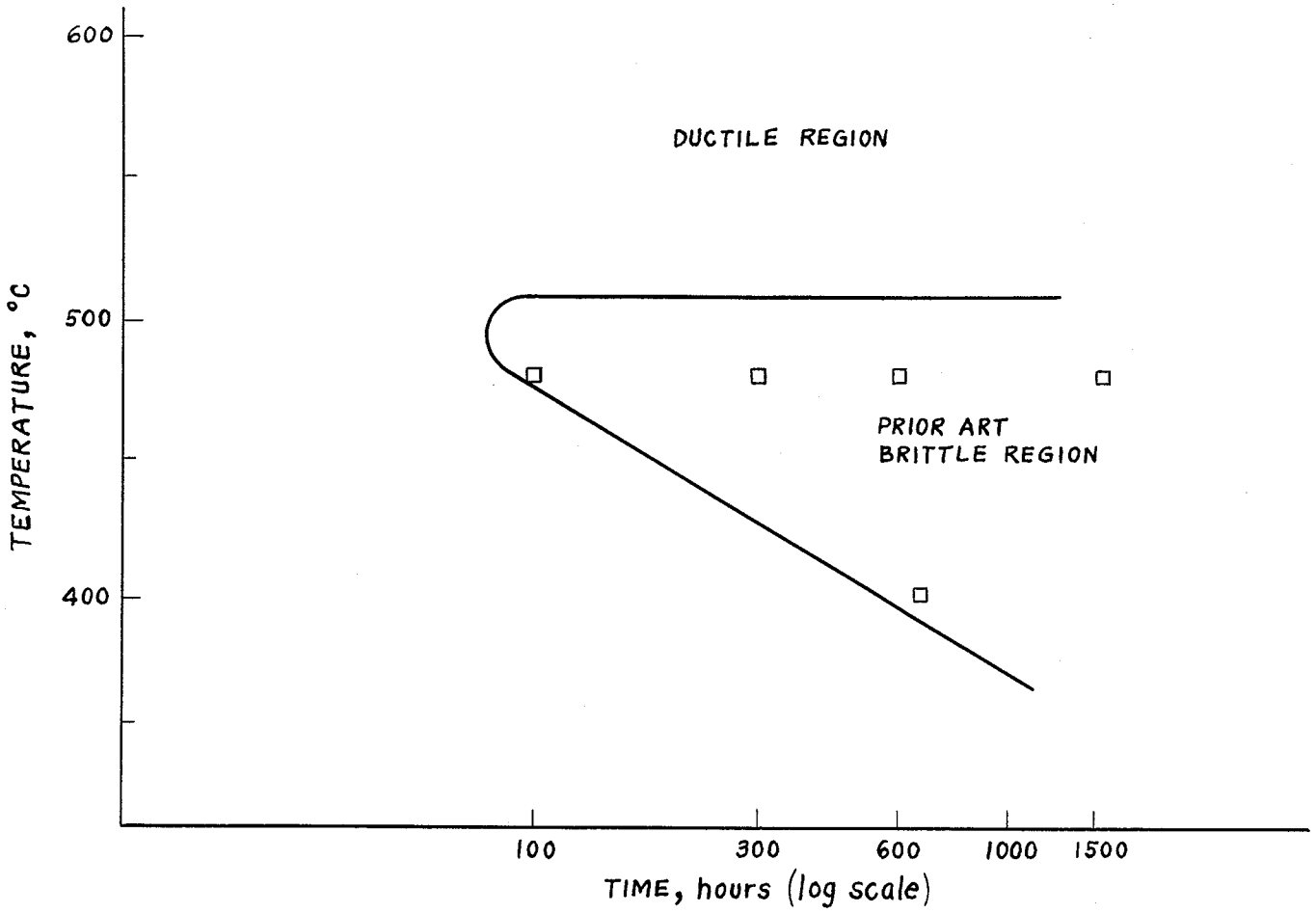
FIG. 5 illustrates the effect of time and temperature on the onset of embrittlement of an aluminum-zinc coated steel sheet, where the base steel nominally contains no more than about 0.01%, by weight, phosphorus, contrasting such coated sheet made according to the prior art with specific data on aluminum-zinc coated steel sheet made according to this invention.

As mentioned in the Background of the Prior Art, aluminum-zinc alloy coated steels (nominal coating composition of 55% Al, 1.6% Si, balance Zn) exhibit a specific and limited embrittling temperature range. FIG. 3A illustrates this general concept as a function of temperature, whereas FIG. 5 shows such concept more specifically, with the additional variable of time for 55 Al-Zn alloy coated steel. With regard to FIG. 5, the maximum temperature, independent of time, occurs at about 950° F. (510° C.), while the lower temperature decreases with time at temperature. This brittle region defined by the triangular shaped area of FIG. 5 illustrates graphically the limited usefulness of aluminum-zinc alloy coated steel sheet when manufactured under the teachings of the prior art. By way of example, a 55 Al-Zn alloy coated, low-phosphorus, plain carbon steel, produced according to the prior art and exposed for 600 hours at a temperature between about 750° F. (399° C.) and 950° F. (510° C.) becomes embrittled. However, by following the teachings of this invention, namely, using a phosphorus enriched, plain carbon steel base for the reception of the zinc-containing metallic coating, the embrittlement problem is no longer a limiting factor in elevated temperature service for the coated product. Note the data points, representing non-embrittled invention products, within the triangular shaped area of FIG. 5. This shows that by following the teaching of this invention the embrittling temperature regions shown in FIGS. 3A, 3B and 5 are eliminated and no longer represent a service limiting factor.

We claim:

1. A ductile, metallic coated ferrous metal product, where said metallic coating contains zinc as a component thereof in an amount sufficient to penetrate into said ferrous metal and cause embrittlement when exposed to elevated temperatures for prolonged periods of time, said product heated for prolonged periods of time at temperatures above 450° F. (232° C.) and cooled to ambient temperatures, characterized in that said ferrous metal is a plain carbon steel containing at least 0.030%, by weight, phosphorus, that said plain carbon steel is resistant to intergranular penetration by zinc and embrittlement, and that said periods of time are such as to cause embrittlement in a like coated plain carbon steel containing no more than about 0.015%, by weight, phosphorus.

2. The coated ferrous metal product of claim 1 wherein said metallic coating is galvanized coating, characterized in that said heating temperature is between about 635° to 750° F. (334° to 399° C.).

3. The coated ferrous metal product of claim 1 wherein said metallic coating comprises an alloy consisting of from 25 to 70%, by weight aluminum, balance essentially zinc with a small addition of silicon, characterized in that said heating temperature is between about 650° to 950° F. (343° to 510° C.).

4. The coated ferrous metal product of any one of claims 1, 2 or 3, characterized in that the phosphorus content of said ferrous metal is at least 0.039%.

5. The coated metal product of claim 4, characterized in that said product is in the form of a sheet or strip.

6. A ductile, composite metal product having a plain carbon ferrous core and an outer layer of a metallic coating containing zinc as a component thereof in an amount sufficient to penetrate into said plain carbon ferrous core and cause embrittlement when exposed to elevated temperatures for prolonged periods of time, said product adapted for prolonged use at temperatures above about 450° F. (232° C.), characterized in that said ferrous core contains at least 0.030%, by weight, phosphorus, that said ferrous core is resistant to intergranular penetration by zinc and embrittlement, and that said prolonged use at temperatures above about 450° F. (232° C.) are such as to cause embrittlement in a like coated composite metal product having a plain carbon ferrous core containing no more than about 0.015%, by weight, phosphorus.

7. The composite metal product of claim 6 characterized in that said outer layer is a galvanized coating.

8. The composite metal product of claim 6 characterized in that said outer layer comprises an alloy consisting of from 25 to 70%, by weight aluminum, balance essentially zinc with a small addition of silicon.

9. The composite metal product of any one of claims 6, 7 or 8, characterized in that the phosphorus content of said core is at least 0.039%.

10. The composite metal product of claim 9, characterized in that said product is in the form of a sheet or strip.

11. An automotive exhaust component adapted for use at temperatures above about 450° F. (232° C.) and formed from a ferrous metal sheet having on a surface thereof a metallic coating containing zinc as a component thereof in an amount sufficient to penetrate into said ferrous metal sheet and cause embrittlement when exposed to said temperatures for prolonged periods of time, said ferrous sheet being resistant to intergranular penetration by zinc and embrittlement when used at said elevated temperatures, characterized in that said ferrous metal is a plain carbon steel containing at least 0.030%, by weight, phosphorus and the thus coated sheet remains ductile at room temperature after use at said elevated temperature.

12. The automotive exhaust component of claim 11 wherein said metallic alloy coating is a galvanized coating, characterized in that said ferrous metal sheet is resistant to intergranular penetration by zinc and embrittlement and that said temperature of use is between about 635° to 750° F. (334° to 399° C.).

13. The automotive exhaust component of claim 11 wherein said metallic alloy coating comprises an alloy consisting of from 25 to 70%, by weight aluminum, balance essentially zinc with a small addition of silicon, characterized in that said ferrous metal sheet is resistant to intergranular penetration by zinc and embrittlement and that said temperature of use is between about 650° to 950° F. (343° to 510° C.).

14. The automotive exhaust component according to any one of claims 11, 12 or 13, characterized in that the phosphorus content of said ferrous metal is at least 0.039%.

* * * * *